United States Patent [19]

Thompson

[11] 4,279,567

[45] Jul. 21, 1981

[54] ATTACHMENT FOR LIFT TRUCK

[75] Inventor: Larry J. Thompson, Pembroke Pines, Fla.

[73] Assignee: Equipment Company of America, Hialeah, Fla.

[21] Appl. No.: 97,464

[22] Filed: Nov. 26, 1979

[51] Int. Cl.[3] ..... B66C 1/00

[52] U.S. Cl. ..... 414/785; 414/910

[58] Field of Search ..... 414/607, 785, 908, 910, 414/911

[56] References Cited

U.S. PATENT DOCUMENTS

| | | | |
|---|---|---|---|
| 2,841,300 | 7/1958 | Berquist | 414/908 X |
| 4,005,793 | 2/1977 | Smith | 414/607 |

*Primary Examiner*—Robert G. Sheridan

*Attorney, Agent, or Firm*—Cullen, Sloman, Cantor, Grauer, Scott & Rutherford

[57] ABSTRACT

A lift attachment for a lift truck or other vehicle or support having a vertically adjustable lift bar. The lift attachment includes a housing with upright side walls which bear against the lift bar, a top flange and a bottom mount block which receives and supports one end of a forwardly extending lift rod for supporting coiled goods. The top flange has an upper catch bar extending downwardly and rearwardly for suspension from the top edge of the lift bar of the truck. A pair of catch plates are adjustably mounted upon the lower end of the side walls and include up-turned rearwardly extending lower catches to retainingly engage the bottom edge of the lift bar.

16 Claims, 4 Drawing Figures

ATTACHMENT FOR LIFT TRUCK

BACKGROUND OF THE INVENTION

Lift trucks conventionally have a pair of forks extending forwardly thereof for supportably receiving, transporting, lifting and stacking various materials including drums, boxes, containers and manufactured goods. The conventional fork lift truck is not particularly adapted or suited for the lifting and transporting of coiled materials such as coiled carpets or rugs or coils of steel usually of cylindrical form and having a longitudinal central aperture.

The problem in handling coiled materials of this nature is that the conventional fork lift truck is not provided with a means which will engage a coil of material through the central aperture in the coil so as to effectively support such coil of material for transporting, lifting, stacking or storing.

SUMMARY OF THE INVENTION

A feature of the present invention is to provide a lift attachment for a lift truck or other vehicle which has a vertically adjustable lift bar, with such lift attachment being particularly adapted for the supporting and mounting and transporting of a coil of material such as rugs, carpets, steel or other goods.

Another feature of the present invention is to provide a lift attachment which may be easily, efficiently and supportably mounted upon the lift bar of a lift truck and which mounts or carries a forwardly extending lift rod adapted for projection into the longitudinal aperture of a coil of material for movement and transport and storage.

Still another feature of the present invention is to provide a lift attachment which includes a housing having side walls, a top flange and a bottom mount block which receives and supports one end of a forwardly extending lift rod. The top flange includes an upper catch bar which extends downwardly and rearwardly for suspension upon the lift bar. A pair of catch plates are adjustably mounted upon the lower ends of the side walls of the housing and include up-turned rearwardly extending lower catches to retainingly engage the bottom edge of the lift bar.

A further feature of the present invention is to provide an improved lift attachment whose opposed side walls at the rear edges thereof cooperatively bear against the forward surface of a lift bar and whose top flange includes a transverse upper catch bar which extends downwardly and rearwardly therefrom to receive and to cooperatively engage and be suspended from the top edge of the lift bar. Opposed pairs of catch plates are adjustably mounted upon the lower ends of each of the side walls and depend therefrom and include rearwardly and upwardly extending lower catches which cooperatively and retainingly receive and engage the undersurface of the lift bar whereby the lift attachment is conveniently and easily mounted and supported and suspended upon the lift bar of a support or lift truck or other vehicle mounted on wheels.

These and other objects will be seen from the following specification and claims in conjunction with the appended drawings.

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
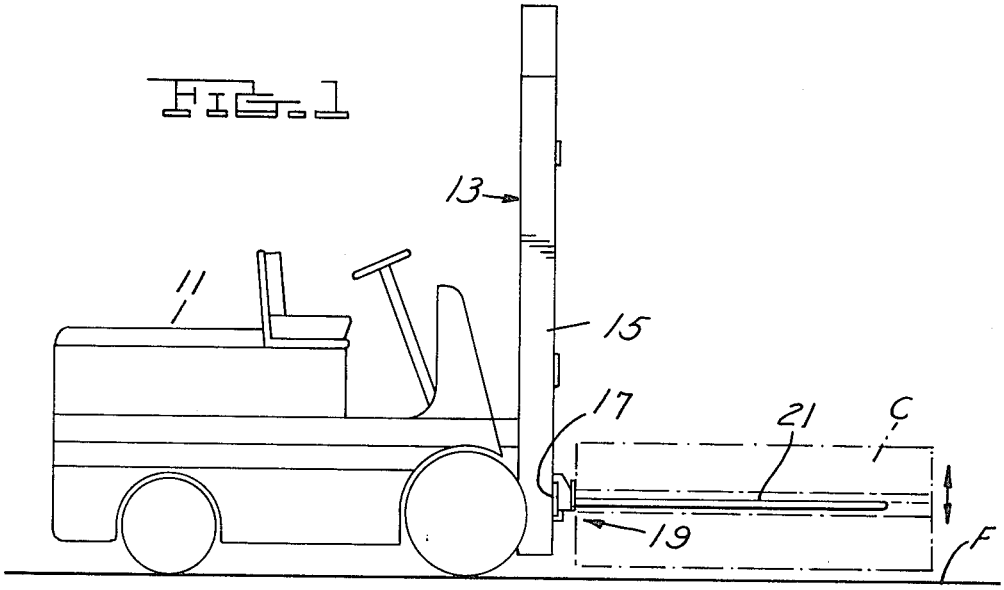
FIG. 1 is a schematic side elevational view of a conventional lift truck having a vertically adjustable lift bar to which the present lift attachment is secured.

A conventional lift truck 11 schematically shown in FIG. 1 is supported by a floor surface F and includes an upright hollow lift frame 13 having a pair of spaced side walls 15 between which is adjustably mounted in a conventional manner a transverse upright lift bar 17 upon which the present lift attachment 19 is removably mounted. It is contemplated that the lift bar 17 could be supported on any other base, support or vehicle having wheels or rollers and which is capable of vertical adjustments and for movement over a floor surface for the transporting of materials. In this instance the lift attachment 19 is primarily directed to transporting materials which have been formed in rolls or coils such as rugs, carpets, steel, or other coiled goods.

Figure 4:
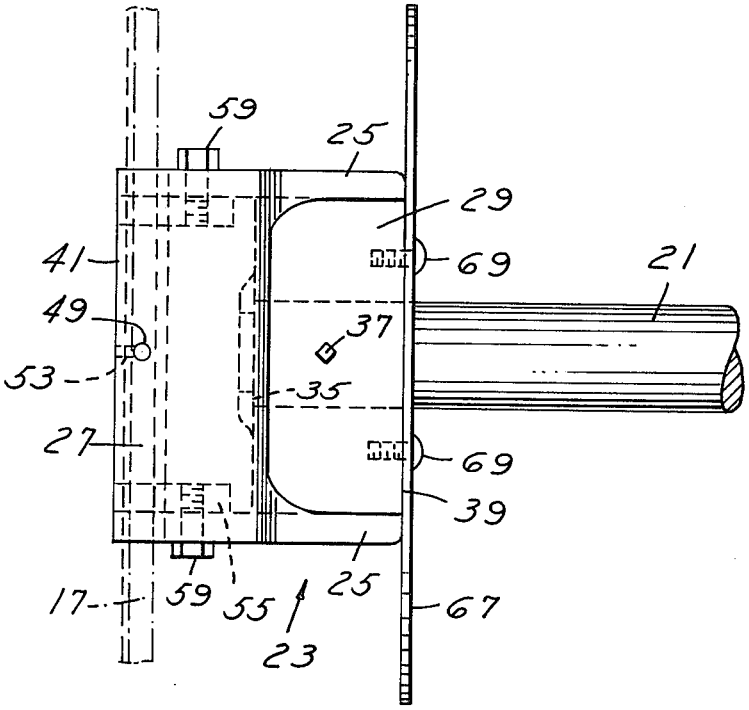
FIG. 4 is a plan view of the lift arrachment of FIG. 2, with the lift rod broken away.
Figure 2:
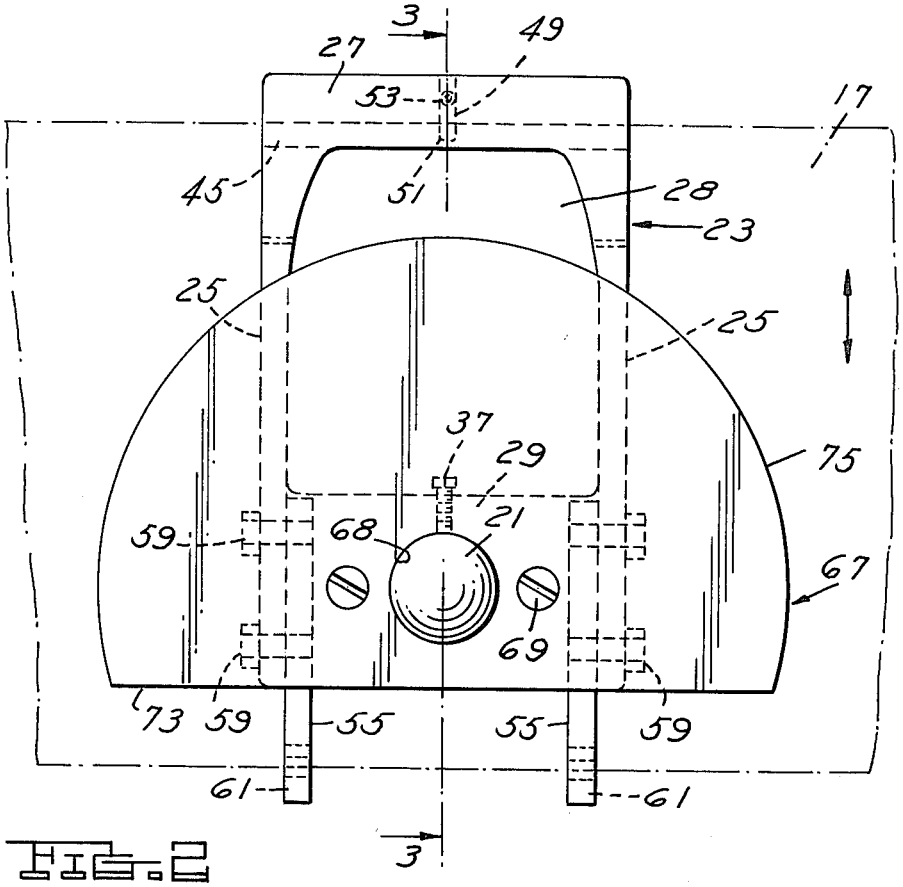
FIG. 2 is a front elevational view of the lift attachment, on an enlarged scale and with the lift bar fragmentarily shown.
Figure 3:
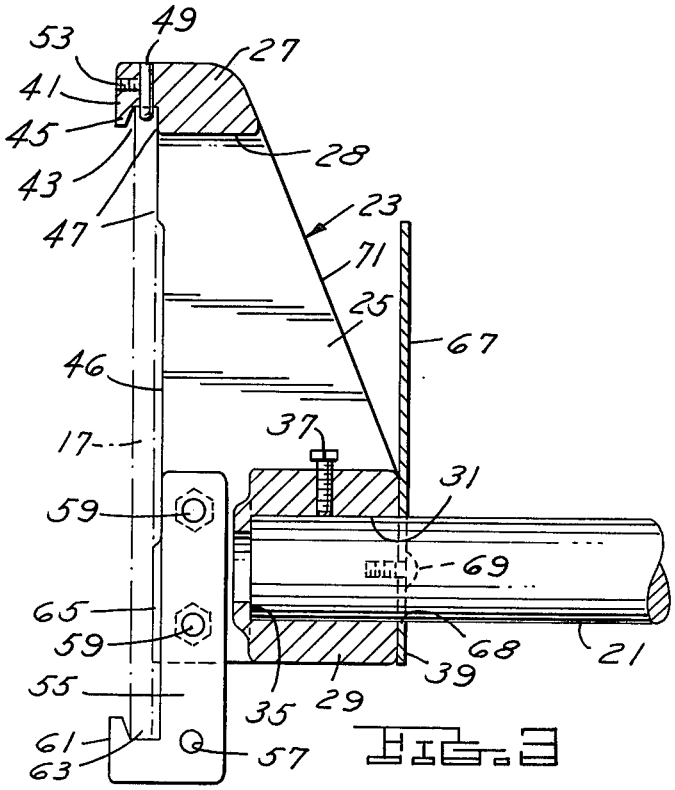
FIG. 3 is a fragmentary vertical section looking in the direction of arrows 3—3 of FIG. 2.

The lift attachment generally indicated at 19 for the coil of material shown schematically at C in FIG. 1, is shown in further detail in FIGS. 2, 3 and 4 of the drawings.

The lift attachment 19 includes a forwardly extending generally solid elongated lift rod 21 which at one end is secured to the hollow housing 23 which is preferably constructed of cast ductile iron for illustration purposes. The lift attachment housing 23 includes a pair of upright spaced side walls 25 which include a transverse top flange 27, FIG. 2, and the transverse mount block 29 which interconnects the lower ends of the side walls 25. A transverse forwardly extending bore 31 provided in the mount block 29 is adapted to cooperatively receive one end of the lift rod 21 fragmentarily shown in FIG. 3.

Counterbore 33 within the mount block 29 defines a stop shoulder 35 to cooperatively receive and engage one end of the lift rod 21. Set screw 37 is transversely threaded into the mount block 29 and frictionally and retainingly engages the lift rod 21 adjacent the front face 39 of the mount block 29 as best shown in FIG. 3.

Upper catch bar 41 is connected to the top flange 27 and extends downwardly and rearwardly therefrom and has a transverse undercut slot 43 defining the down-turned tapered lip 45 spaced from the upper stop surface 47 which is located at one edge of the side walls 25 and along the rear of the transverse top flange 27. The catch bar 41 is elongated and has a length equal to the length of the top flange 27.

Each of the side walls 25 along its rearward upright edge has formed an elongated recess 46 which defines within the rearward upright edge the upper stop surface 47 and the lower stop surface 65, both of which cooperatively engage the outer surface of the upright lift bar 17 as best illustrated in FIG. 3.

An upright index or indexing pin 49 extends through the upper catch bar 41 adjacent flange 27 and into the undercut slot 43 and is adapted for cooperative registry within an upright bore or slot 51 formed within the top surface of lift bar 17. Set screw 53 extends transversely through upper catch bar 41 and frictionally and operatively engages the index pin 49 for securing the pin 49 relative thereto so as to retainingly engage the lift bar 17. The primary purpose of the indexing pin 49 is to lock and retain the housing 23 of the lift attachment 19 against relative longitudinal movement with respect to the lift bar 17. It is contemplated that there may be a series of longitudinally spaced bores 51 along the top surface of the lift bar 17 should it be desired to differently locate the lift attachment 19 or to provide for the mounting for a pair of such lift attachments 19.

Mounted upon the lower interior surfaces of the side walls 25 are a pair of laterally spaced opposed catch plates 55 which have formed therethrough a series of longitudinally spaced vertically aligned threaded bores 57. A pair of vertically spaced machine bolts 59 extend through the side walls 25 and threadingly engage within a pair of bores 57 selectively of the catch plates 55 for securing the lower catch plates 55 upon the housing 23.

The catch plates 55 are of J-shape (FIG. 3) with their respective lower ends terminating in the rearwardly extending upwardly inclined tapered catch 61. Rearwardly extending portions of the catches 61 have a transverse slot 63 therein adjacent the stop surface 65 adapted to cooperatively register with and retainingly engage the bottom edge of the lift bar 17.

The transverse slots 63 are in vertical registry with the undercut slot 43 within the upper catch bar 41 for cooperatively receiving and engaging the respective top and bottom edges of the lift bar 17 with the stop surfaces 47 and 65 bearing against the outer surface of the lift bar 17 as shown in FIG. 3. The taper lip 45 and catches 61 retainingly engage the rear side of the lift bar 17 at the top and bottom edges, respectively. This effectively secures the lift attachment 19 to the lift bar 17 and at the same time provides for its easy removal or for a lateral adjustment along the surface of the lift bar 17 should this be desired for locating the lift attachment 19 other than centrally thereof.

The individual catch plates 55 as shown in FIG. 3 have an unused threaded bore 57 whereby the lift attachment is adapted for connection to a transverse lift bar 17 of reduced height from the one shown in FIG. 3. All that is necessary is that the lower-most pair of threaded bores 57 be elevated so as to be in alignment with corresponding apertures in the side walls 25 to receive the fasteners 59. Accordingly the present lift attachment is readily attachable to lift bars of different heights.

As best illustrated in FIG. 2, the housing 23 is of U-shaped cross section which as mentioned previously is preferably constructed of cast ductile iron. The side walls 25 are in the form of elongated legs connected at the upper ends by the top flange 27. The walls or legs 25 and the top flange 27 surround a straight through cavity or opening 28. Thus a person viewing the lift attachment 19 from the front will be able to see the lift bar 17 through the opening or cavity 28.

In the illustrative embodiment of the invention an upright stop shield 67 is optionally employed. The shield 67 forms an abutment surface for one end of a coil to prevent damage to the coil of goods, such as a coil of rugs. The stop shield 67 bears against the front face 39 of the mount block 29 and is secured thereto by a pair of fasteners 69. The top shield 67 has an aperture 68 therethrough to cooperatively receive lift rod 21 as shown in FIG. 3.

The forward edges of the side walls 25 of housing 23 are inclined downwardly and outwardly as at 71 so that the side walls 25 are wider at the bottom than at the top. This therefore provides for the location of the mount block 29 so as to extend to the forward lower edge of the side walls 25 at the same time leaving sufficient space adjacent the rearward edge of the side walls 25 for the mounting for the respective catch plates 55 as shown in FIG. 3. At the same time upper portions of the stop shield 67 are spaced forwardly of inclined portions 71 of the side walls 25.

The stop shield 67 is in the form of a plate of uniform thickness, as an example $\frac{1}{8}''$ thick, having a generally horizontal bottom edge 73 and a curved edge 75 connecting the opposing end portions of the bottom edge 73 as shown in FIG. 2.

While the present lift attachment 19 is sometimes referred to as a "rug ram", it is particularly adapted for any type of cylindrically formed material and particularly coiled or rolled carpets or rugs or coiled steel or other apertured cylindrical objects which are to be transported and lifted and stored or otherwise relocated. While reference is made to a lift attachment for a lift truck it is contemplated that the present lift attachment may be connected to a support or other vehicle or framework on wheels or rollers and which has a vertically adjustable horizontal lift bar.

Having described my invention reference should now be had to the following claims.

I claim:

1. A lift attachment for a support having a lift frame and an upright lift bar with top and bottom edges vertically adjustable thereon;

said lift attachment comprising a hollow housing having a pair of upright spaced side walls for bearing against the lift bar;

a transverse top flange connecting the upper ends of said side walls and a transverse mount block located between the lower ends thereof;

there being a forwardly extending bore in said mount block;

a lift rod at one end projected into and secured within said block bore and extending forwardly of the housing for supporting coiled goods;

an elongated down-turned upper catch bar extending rearwardly of the top flange and adapted to be supportably mounted and suspended over the top edge of the lift bar;

a pair of opposed upright catch plates bearing against the housing side walls, secured thereto and depending therefrom; and p1 each of said catch plates having an up-turned lower catch extending rearwardly and adapted to retainingly engage the bottom edge of the lift bar.

2. In the lift attachment of claim 1, there being a counterbore in said mount block defining a stop shoulder engageable with the lift rod.

3. In the lift attachment of claim 1, a set screw threaded transversely into the mount block frictionally and retainingly engaging said lift rod.

4. In the lift attachment of claim 1, the side walls along the forward edges of said housing being inclined forwardly and outwardly, the catch plates being located rearwardly of said mount block.

5. In the lift attachment of claim 1, the rear edges of the side walls of said housing being upright and adapted to cooperatively and retainingly bear against the lift bar to restrain the cantilever effect of the lift rod.

6. In the lift attachment of claim 1, the rear edges of the side walls of said housing being upright with opposed elongated slots therein intermediate their ends defining upon each side wall rear edge a pair of spaced stop surfaces adapted to retainingly engage the lift bar.

7. In the lift attachment of claim 1, the undersurface of the upper catch bar having a transverse undercut slot, and a right angular extension at the lower end of each catch plate with a transverse slot in the top surface of the extension in vertical registry with the catch bar slot and defining the lower catches, the slots cooperatively adapted to receive the top and bottom edges of the lift bar, with portions of the catch bar and catches for retainingly engaging the lift bar.

8. In the lift attachment of claim 1, the undersurface of the upper catch bar having a transverse undercut slot cooperatively adapted to receive the top edge of the lift bar;

and an upright indexing pin adjustably mounted and secured upon the catch bar and extending into its undercut slot for cooperative retaining registry within a corresponding bore in the top edge of the lift bar, the indexing pin being adapted to prevent longitudinal movement of said housing relative to the lift bar.

9. In the lift attachment of claim 8, the securing of the indexing pin including a set screw threaded into said upper catch bar and frictionally engaging the indexing pin.

10. In the lift attachment of claim 1, each catch plate bearing against the interior of one side wall and having a series of spaced vertically aligned threaded bores therethrough;

and a pair of fasteners extending through corresponding transverse apertures in each side wall and selectively into a pair of threaded bores of a catch plate, whereby the catch plates are vertically adjustable relative to said housing to accommodate lift bars of different heights.

11. In the lift attachment of claim 1, an upright stop shield bearing against the forward side of said housing and secured to said mount block, and having an aperture cooperatively receiving said lift rod.

12. In the lift attachment of claim 1, there being a counterbore in said mount block defining a stop shoulder engageable with the lift rod;

the rear edges of the side walls being upright and adapted to cooperatively and retainingly bear against the lift bar to restrain the cantilever effect of the lift rod.

the undersurface of the upper catch bar having a transverse undercut slot, and a right angular extension at the lower end of each catch plate with a transverse slot in the top surface of the extension in vertical registry with the catch bar slot and defining the lower catches, the slots cooperatively adapted to receive the top and bottom edges of the lift bar, with portions of the catch bar and catches for retainingly engaging the lift bar;

and an upright indexing pin adjustably mounted and secured upon the catch bar and extending into its undercut slot for cooperative retaining registry within a corresponding bore in the top edge of the lift bar, the indexing pin being adapted to prevent longitudinal movement of said housing relative to the lift bar;

each catch plate bearing against the interior of one side wall and having a series of spaced vertically aligned threaded bores therethrough;

and a pair of fasteners extending through corresponding transverse apertures in each side wall and selectively into a pair of the threaded bores of a catch plate, whereby the catch plates are vertically adjustable relative to said housing to accommodate lift bars of different heights.

13. In the lift attachment of claim 12, an upright stop shield bearing against the forward side of said housing and secured to said mount block, said block having an aperture therein cooperatively receiving said lift rod.

14. In the lift attachment of claim 13, wherein said stop shield is of uniform thickness, and includes a generally horizontal bottom edge and a curved edge connecting the opposing end portions of said bottom edge.

15. The lift attachment defined in claim 1 in combination with a lift truck.

16. The lift attachment defined in claim 12 in combination with a lift truck having a support having a lift frame and an upright lift bar with top and bottom edges vertically adjustable thereon.

* * * * *